US006099979A

United States Patent [19]

Inoguchi et al.

[11] Patent Number: 6,099,979

[45] Date of Patent: Aug. 8, 2000

[54] ELECTROLUMINESCENT DISPLAY ELEMENT AND MANUFACTURING METHOD FOR MANUFACTURING SAME

[75] Inventors: Kazuhiro Inoguchi, Toyota; Hajime Ishihara, Nagoya; Nobuei Ito, Chiryu; Tadashi Hattori, Okazaki; Yutaka Hattori, Okazaki, all of Japan

[73] Assignee: Denso Corporation, Kariya, Japan

[21] Appl. No.: 08/903,690

[22] Filed: Jul. 31, 1997

Related U.S. Application Data

[63] Continuation-in-part of application No. 08/598,529, Feb. 8, 1996.

[30] Foreign Application Priority Data

| | | | |
|---|---|---|---|
| Jul. 24, 1995 | [JP] | Japan | 7-187368 |
| Dec. 21, 1995 | [JP] | Japan | 7-333558 |
| Aug. 2, 1996 | [JP] | Japan | 8-205019 |

[51] Int. Cl.[7] ..... H05B 33/00

[52] U.S. Cl. ..... 428/690; 428/917; 313/500; 313/505; 313/512

[58] Field of Search ..... 428/690, 917; 313/500, 505, 512

[56] References Cited

FOREIGN PATENT DOCUMENTS

| | | |
|---|---|---|
| 60-15115 | 4/1985 | Japan . |
| 2-112195 | 4/1990 | Japan . |
| 4-190588 | 7/1992 | Japan . |
| 5-21278 | 5/1993 | Japan . |
| 7-66858 | 7/1995 | Japan . |

*Primary Examiner*—Charles Nold
*Attorney, Agent, or Firm*—Pillsbury Madison & Sutro LLP

[57] ABSTRACT

In an electroluminescent element in which a first electrode, a first insulating layer, a luminescent layer, a second insulating layer and a second electrode are sequentially laminated on a substrate, the luminescent layer has a first and second luminescent portions which are located apart from each other. A color filter is provided above one of the first and second luminescent portions. The second electrode includes a first part electrode for activating the first luminescent portion and a second part electrode for activating the second luminescent portion. The color filter is formed so that a portion extending from a bottom face of the color filter is inserted into a gap between the first and second luminescent portions to surround an upper face and side faces of the one of the first and second luminescent portions.

16 Claims, 15 Drawing Sheets

FIG. 4
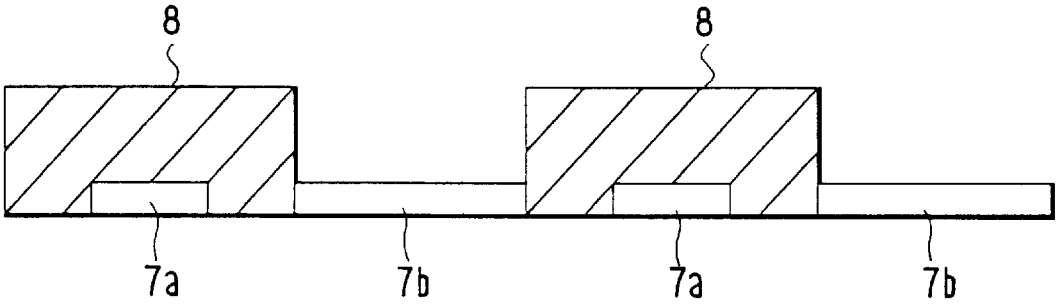
FIG. 5 PRIOR WORK
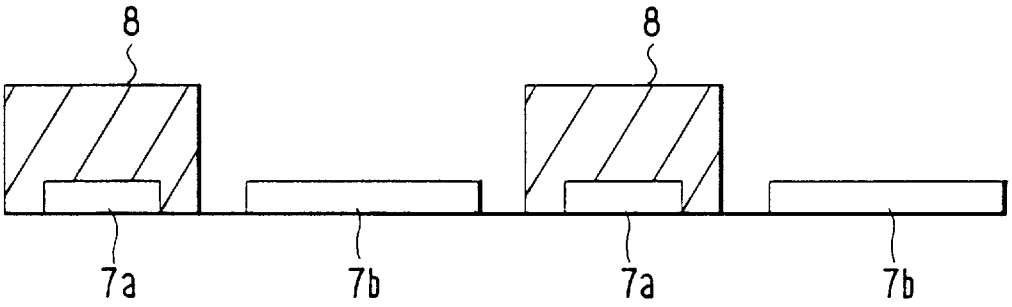

| | PIXEL | | PANEL | |
|---|---|---|---|---|
| | x | y | x | y |
| PRIOR WORK IN FIG. 5 | 0.62 | 0.37 | 0.59 | 0.40 |
| FIRST EMBODIMENT | 0.62 | 0.37 | 0.61 | 0.38 |
| SECOND EMBODIMENT | 0.62 | 0.37 | 0.62 | 0.37 |

FIG. 20 PRIOR WORK
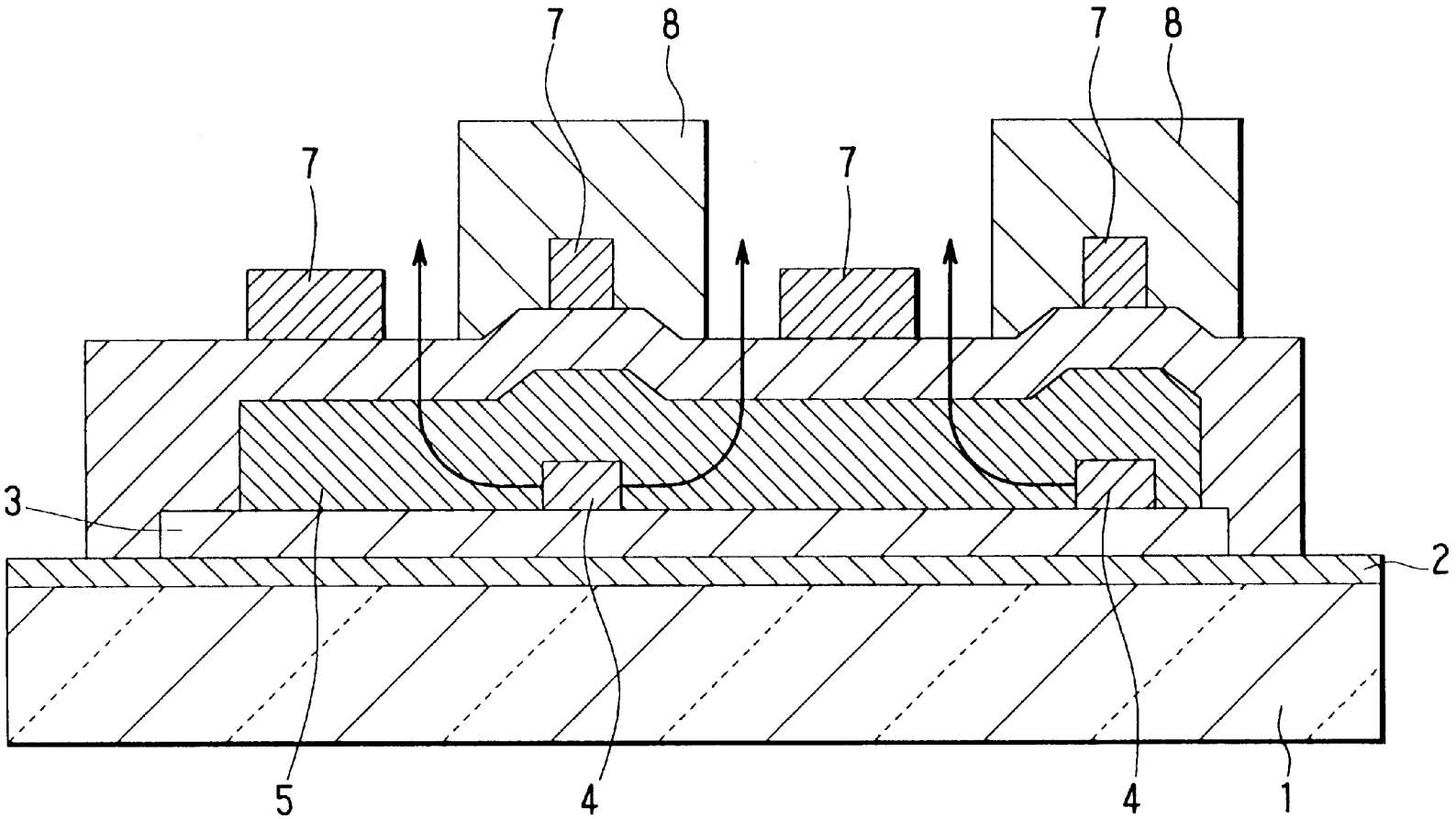

ELECTROLUMINESCENT DISPLAY ELEMENT AND MANUFACTURING METHOD FOR MANUFACTURING SAME

CROSS REFERENCE TO RELATED APPLICATION

This application is a continuation-in-part of U.S. application Ser. No. 08/598,529, allowed filed on Feb. 8, 1996 and claims the benefit of priority of the prior Japanese Patent Applications No. 7-187368 filed on Jul. 24, 1995, No 7-333558 filed on Dec. 21, 1995 and No. 8-205019 filed on Aug. 2, 1996, the contents of which are incorporated herein by reference.

BACKGROUND OF THE INVENTION

1. Field of the Invention

The present invention relates to an electroluminescent display element and, particularly, relates to a multi-color electroluminescent display element utilizing a color filter.

2. Related Art

A color of light emitted from an electroluminescent element is yellowish orange when ZnS (zinc sulfide) is used as a host material and Mn (manganese) serving as a luminescent center is doped thereto while, it is green when Tb (terbium) serving as a luminescent center is doped thereto.

Japanese Patent Application Laid-Open No. Hei.2-112195 discloses an electroluminescent element wherein a luminescent layer of ZnS:Mn using ZnS as a host material and having Mn, serving as a luminescent center, doped thereto and a luminescent layer of ZnS:Tb using ZnS as a host material and having Tb, serving as a luminescent center, doped thereto are laminated one on the other; and red-color and green-color filters are provided on the resultant structure, thereby making emission of multi-color light.

In the multi-color electroluminescent display element using such color filters, loss of transmission of light due to the color filters is large.

The Assignee of this application has filed U.S. patent application Ser. No. 08/598529, disclosing an electroluminescent element in which a luminance of emitted light of green color was increased by providing only a red color filter. In the electroluminescent element, as shown in FIG. 20, a luminescent layer 5 of ZnS:Tb is laminated on a luminescent layer 4 of ZnS:Mn formed in a predetermined pattern, and red color filters 8 are deposited in correspondence to laminated portions of the luminescent layer 4 of ZnS:Mn and the luminescent layer 5 of ZnS:Tb. Light of green color is emitted from single-layer portions consisting of the luminescent layer 5 of ZnS:Tb and light of red color is emitted from the laminated portions via the red color filters 8. It is to be noted that numbers in the figure corresponds to the numbers used to describe preferred embodiments later.

The inventors have gone ahead with studies on an electroluminescent element which has such a color filter and emits lights of multi colors. As a result, they have found out that light from a luminescent layer located below a color filter leaks out of the color filter without passing therethrough, thereby deteriorating purity of color.

For example, in the electroluminescent element illustrated in FIG. 20, light of yellowish orange color emitted from the luminescent layers 4 of ZnS:Mn leaks out of the redcolor filters 8 as shown by arrows in the figure. Accordingly, light of red color passing through the red-color filters 8 and light of yellowish orange leaking out thereof are mixed, thereby deteriorating purity of color.

SUMMARY OF THE INVENTION

In view of the above problems of the prior work, it is an object of the present invention to improve purity of color in a multi-color electroluminescent display element having a color filter.

Another object of the present invention is to provide the manufacturing method for manufacturing the above-described electroluminescent display element.

In an electroluminescent display element according to the present invention, a first electrode, a first insulating layer, a luminescent layer, a second insulating layer and a second electrode are sequentially laminated on a substrate. The luminescent layer has a first and second luminescent portions which are located apart from each other. A color filter is provided above at least one of the first and second luminescent portions. The second electrode is divided into a first part electrode for activating the first luminescent portion and a second part electrode for activating the second luminescent portion. The color filter is formed so that a side face of the color filter reaches a side edge of either of the first and second part electrodes which activates a luminescent portion adjacent to a luminescent portion above which the color filter is provided. As a result, it can be restrained that light emitted from the first luminescent portion leaks out of the color filter. That is, it can be prevented that light leaks from a gap of the color filter and either one of the first and second part electrodes.

Further, the electroluminescent display element may be constructed so that the first luminescent portion and the second luminescent portion in the luminescent layer are located apart from each other on the same plane, and the color filter which is formed above one of the first and second luminescent portions is disposed so that a portion extending from a bottom face of the color filter gets into a gap between the first and second luminescent portions, whereby the color filter surrounds the upper and side faces of one of the first and second luminescent portions.

According to the electroluminescent display element described above, because light advancing laterally from the luminescent portion located under the color filter passes through the color filter, it is restrained that light leaks out of the color filter without passing therethrough. As a result, purity of color in the electroluminescent display element can be improved.

It is to be noted that the first and second luminescent portions are not limited to be completely separated from each other but may be partially connected to each other, as described in a preferred embodiment described later.

Further, the first luminescent portion may be formed by a laminated portion in which a second luminescent layer is laminated on a first luminescent layer. The first and second luminescent layers have emission light colors different from each other. The second luminescent portion may be formed by a single-layer portion consisting of the second luminescent layer. The second luminescent layer preferably has a clump electric field intensity higher than that of the first luminescent layer.

In this case, luminance of light emitted from the first luminescent layer can be enhanced in the laminated portion where the first and second luminescent layers are laminated as a result that the clump electric field intensity of the second luminescent layer is higher than that of the first luminescent layer. Therefore, even when the color filter is formed above the laminated portion, higher luminance of the emitted light can be obtained from the laminated portion comparing to a case where only the first luminescent layer is used without being laminated with the second luminescent layer.

If the first luminescent layer is made of zinc sulfide (ZnS) containing manganese (Mn), the second luminescent layer is made of zinc sulfide (ZnS) containing terbium (Tb) and the color filter is a red-color filter, display using multi colors of green and red colors can be executed by the electroluminescent display element.

Also, if the substrate is formed from black-color plate, the red-color filter located on a front side is hardly recognized. As a result, the display can be easily read.

Further, if the second insulating layer formed on the luminescent layer is composed of a second insulating lower-layer having an index of refraction lower than the luminescent layer and a second insulating upper-layer having an index of refraction higher than the second insulating lower-layer, light advancing laterally and diagonally from side faces of one of the first and second luminescent portions located under the color filter is reflected by the second insulating lower-layer having the lower index of refraction. As a result, leakage of light advancing laterally can be further restrained, thereby further enhancing the purity of color.

BRIEF DESCRIPTION OF THE DRAWINGS

These and other objects, features and characteristics of the present invention will be appreciated from a study of the following detailed description, the appended claims and drawings, all of which form a part of this application. In the drawings:

FIGS. 4 and 5 are views illustrating a relationship between second electrodes 7*a* and 7*b* and the width of a red color filter 8 of the first embodiment of the present invention, wherein FIG. 4 illustrates a structure the red color filter 8 of which is formed so that the widthwise edge thereof is in contact with an end of the second electrode 7*b,* and FIG. 5 illustrates a structure the red color filter 8 of which is formed so that the widthwise edge thereof is located apart from the end of the second electrode 7*b;*

FIG. 20 is schematic sectional view illustrating a vertical cross section of an electroluminescent element disclosed in an earlier application made by the present Applicants.

DETAILED DESCRIPTION OF THE PREFERRED EMBODIMENTS

The embodiments of the present invention will be explained hereinafter with reference to the drawings.

(First Embodiment)

Figure 1:
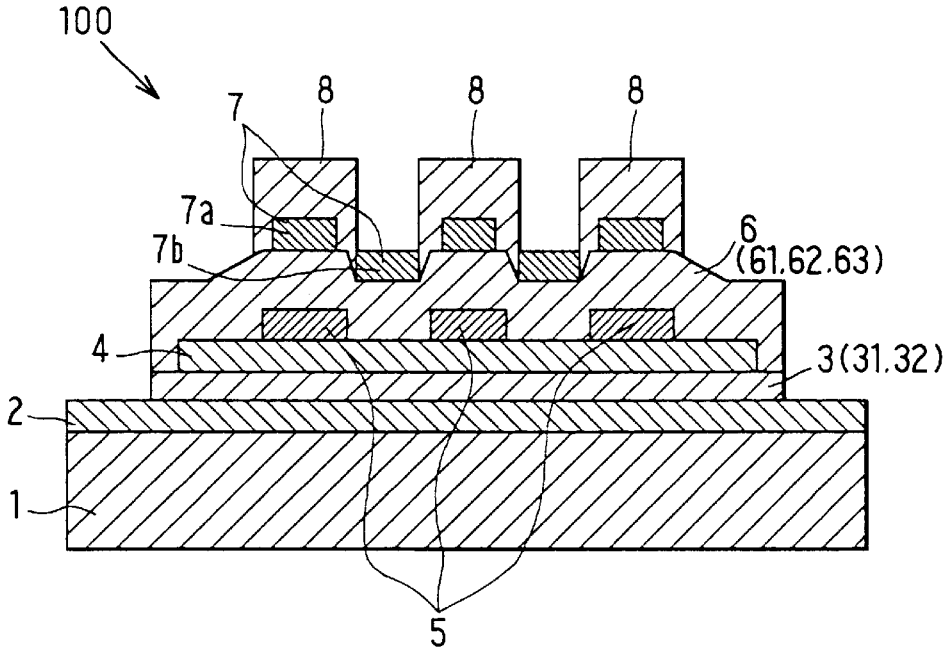
FIG. 1 is a schematic sectional view illustrating a construction of an electroluminescent element of a first embodiment of the present invention.
Figure 2:
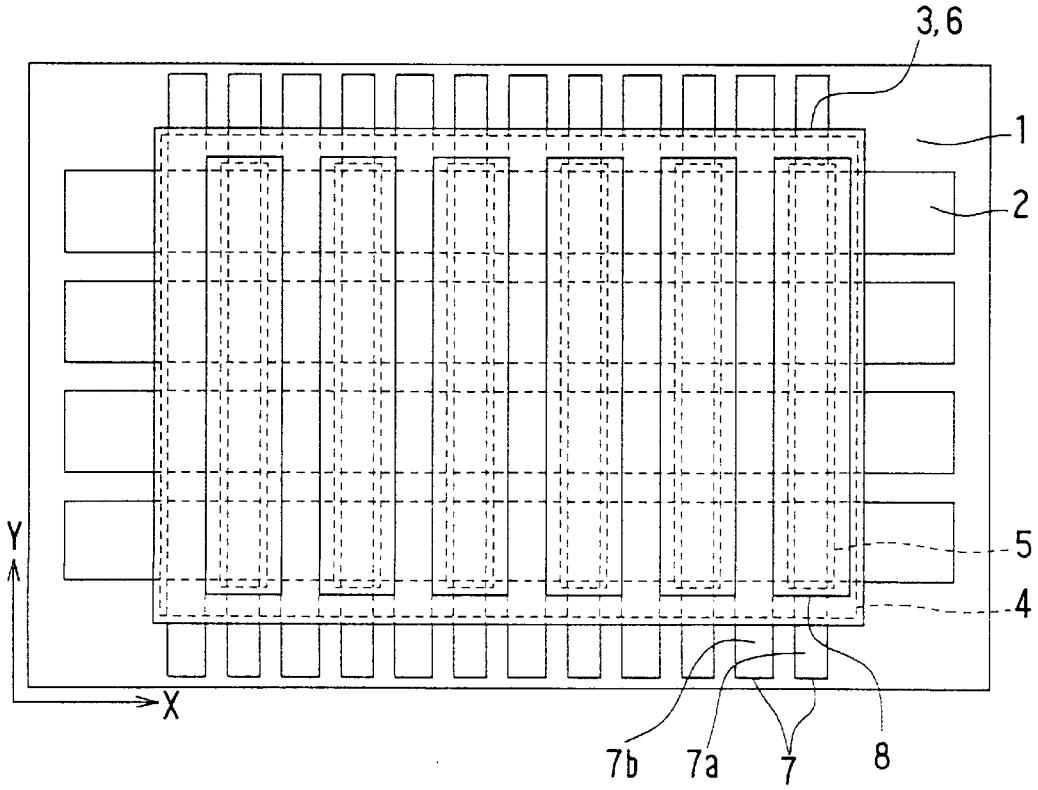
FIG. 2 is a plan view illustrating the arrangement of the first and second electrodes of the electroluminescent element of the first embodiment of the present invention.

FIG. 1 is a typical view illustrating a vertical cross section of an electroluminescent element in a first embodiment, and FIG. 2 is a plan view thereof.

Figure 10:
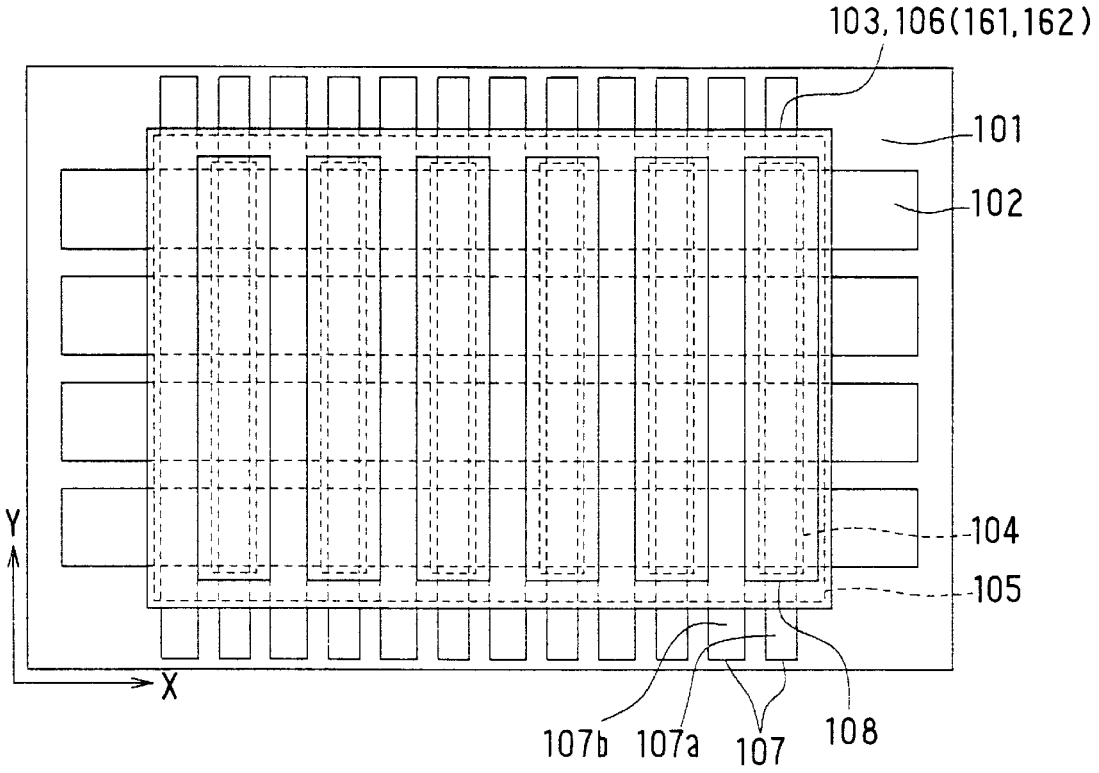
FIG. 10 is a plan view illustrating the electroluminescent element in the second embodiment of the present invention.

In an electroluminescent element 100 according to the first embodiment, a first luminescent layer 4 consisting of a material of ZnS having TbOF doped thereto and having a thickness of 5,000 Å and a second luminescent layer 5 consisting of a material of ZnS having Mn doped thereto and having a thickness of 2,000 Å are formed on a first insulating layer 3. The first insulating layer 3 is composed of two layers, one of which is a first lower insulating layer 31 consisting of an optically transparent $SiO_xN_y$ (silicon oxynitride) and having a thickness of 500 to 1,000 Å and the other of which is a first upper insulating layer 32 consisting of a composite film $Ta_2O_5$:$Al_2O_3$ of $Ta_2O_5$ (tantalum pentaoxide) and $A1_2O_3$ (aluminum oxide). As illustrated in FIG. 10, the second luminescent layer 5 is patterned such that a stripe extending in the y-axis direction is arranged in large number at predetermined space intervals in the x-axis direction.

A second insulating layer 6 is uniformly formed on the first luminescent layer 4 and the second luminescent layer 5. The second insulating layer 6 is composed of three layers, a first one of which is a second lower insulating layer 61 consisting of an optically transparent $Si_3N_4$ (silicon nitride) and having a thickness of 1,000 Å, a second one of which is a second intermediate insulating layer 62 consisting of a composite film of $Ta_2O_5$:$Al_2O_3$ and having a thickness of 2,000 Å, and a third one of which is a second upper insulating layer 63 consisting of $SiO_xN_y$ and having a thickness of 1,000 Å. Also, in this embodiment, red color filters 8 are formed in a region on a second electrode 7 (7*a*) under which the second luminescent layer 5 exists.

As illustrated in FIG. 10, this red color filter 8 has a stripe shape formed on the second electrode 7 in such a manner as to cover this electrode 7 and extending in the y-axis direction, and transmits therethrough light emitted from a laminated portion of the first luminescent layer 4 and the second luminescent layer 5.

Figure 3A:
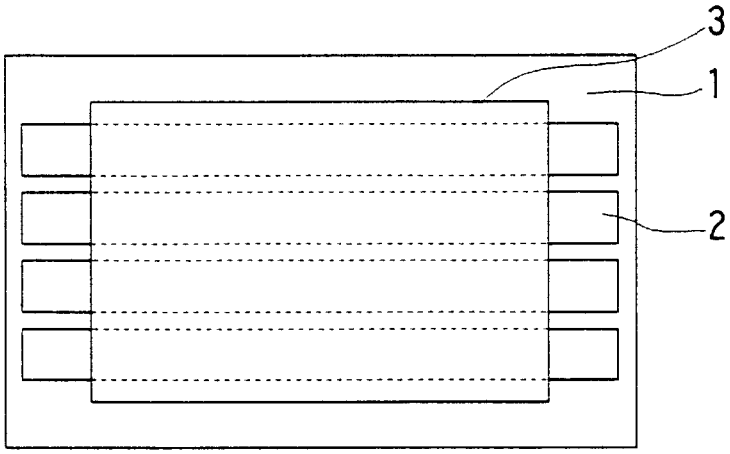
FIGS. 3A to 3C are plan views illustrating a method for manufacturing the electroluminescent element of the first embodiment of the present invention.
Figure 3B:
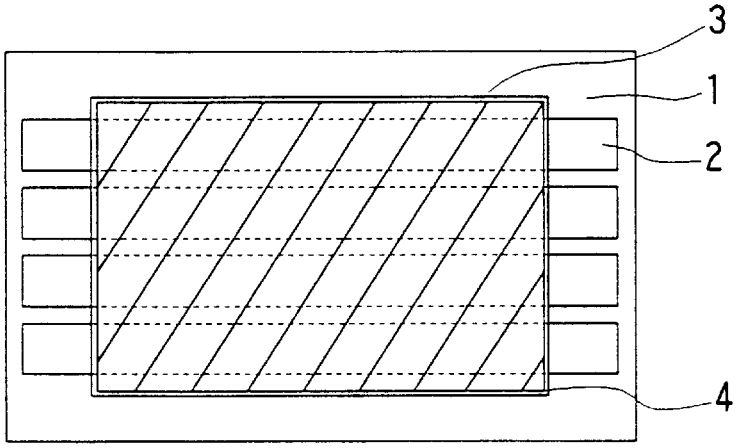
Figure 3C:
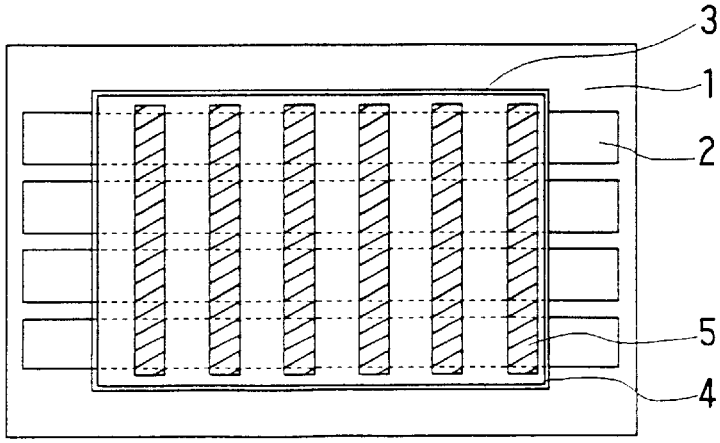

Next, a method for manufacturing the above-mentioned electroluminescent element 100 will be explained below. FIGS. 3A to 3C are plan views illustrating the manufacturing method therefor.

A first electrode 2 and a first insulating layer 3 (first lower insulating layer 31 and first upper insulating layer 32) are formed on a glass substrate 1. This state is illustrated in FIG. 3A.

Then, as illustrated in FIG. 3B, the first luminescent layer 4 consisting of a material of ZnS:TbOF in which ZnS is a host material and TbOF is doped thereto as a luminescent center is formed uniformly on the first upper insulating layer 32. Specifically, sputtering is performed with the glass substrate 1 being maintained at a temperature of 250° C. by using Ar (argon) and He (helium) as sputter gases at a gaseous pressure of 3.0 Pa with a high frequency power of 2.2 KW to thereby perform a film formation.

The glass substrate 1 is thereafter taken out from the sputtering device and then is set within an evaporation device. Therefore, the glass substrate 1 is once exposed in the atmosphere.

Next, a layer consisting of a material of ZnS:Mn in which ZnS is a host material and Mn is doped thereto as a luminescent center is formed uniformly by evaporation on the first luminescent layer 4. Specifically, electron beam evaporation is performed with the glass substrate 1 being maintained at a predetermined constant temperature with the interior of the evaporation device being maintained at a pressure level of $5\times10^{-4}$ Pa or less and at a deposition rate of 0.1 to 0.3 nm/sec.

Next, this layer is etched in a configuration as illustrated in FIG. 3C, thereby the second luminescent layer 5 is obtained. Specifically, the glass substrate 1 is maintained at a temperature of 70° C., a gaseous mixture of Ar and $CH_4$ (methane) is introduced into an RIE device, the gaseous pressure is maintained at a level of 7 Pa, and the high frequency power of 1 kW is used to thereby perform dry etching.

In this case, by using a gaseous mixture of $CH_4$ and Ar (inert gas) as an etching gas, the surface of the second luminescent layer 5 having ZnS as a host material is changed to dimethyl zinc $[Zn(CH_3)_2]$ low in boiling point and gasified and physical etching is simultaneously performed with respect thereto by the action of Ar. Accordingly, since the always refreshed surface thereof permits chemical etching which is performed by $CH_4$ to proceed, it is possible to ensure a rate of etching which is conventionally unattainable and etch the second luminescent layer 5 without causing damage to the luminescent layer 4.

After this etching is performed, the luminescent layers 4 and 5 are heat-treated at 400 to 600° C. in vacuum or in an atmosphere of hydrogen sulfide ($H_2S$). Thereafter, the second insulating layers 61 to 63 are formed and then the second electrode 7 is formed on the second upper insulating layer 63.

Subsequently, the red color filter 8 is formed on the second electrode 7 (7*a*) in a region under which the second luminescent layer 5 exists to thereby obtain an electroluminescent element having a plan view construction as illustrated in FIG. 2.

In the above-mentioned construction, the first luminescent layer 4 emits green color light and the second luminescent layer 5 emits yellowish orange color light. Light emitted from a laminated portion of the first luminescent layer 4 and the second luminescent layer 5 passes through the red color filter 8, whereby red color light of which color purity has been increased by the red color filter 8 is obtained.

In this embodiment, when measured by utilizing the Q-V characteristic (electric charge vs voltage) of the electroluminescent element, the first luminescent layer 4 consisting of ZnS:TbOF is such that the clump electric field intensity is in a range of from 1.8 MV/cm to 2.1 MV/cm and the dielectric constant $\epsilon_a$ is in a range of from 8 to 10. Also, the second luminescent layer 5 consisting of ZnS:Mn is such that the clump electric field intensity is in a range of from 1.4 MV/cm to 1.7 MV/cm and the dielectric constant $\epsilon_a$ is in a range of from 10 to 12. That is, the clump electric field intensity of the first luminescent layer 4 is higher than that of the second luminescent layer 5 and the product of the dielectric constant and clump electric field intensity of the second luminescent layer 5 is larger than the product of the dielectric constant and clump electric field intensity of the first luminescent layer 4. This enables an increase in the luminance of light emitted from the second luminescent layer 5 and a decrease in a luminescence threshold voltage.

At this time, by making the thickness of the second luminescent layer 5 to be 1,000 Å or more, it is possible to obtain a required luminance of the emitted red color light. Also, by making this thickness to be 3,500 Å or less, it is possible to cause the luminescence threshold voltage of the electroluminescent element to fall within a predetermined range. Further, it is possible to operate the electroluminescent element with a drive voltage falling within a limit of the withstand voltage of peripheral parts such as a driver IC, etc.

It is to be noted here that if a luminescent layer emitting yellowish orange color light is disposed on the lower side and a continuous luminescent layer emitting green color light is disposed thereon with the result that there is the likelihood that when the both of the luminescent layers emit lights, the green color light from the upper luminescent layer may leak from a lateral side of a red color filter to deteriorate the color purity. On the other hand, by disposing the second luminescent layer 5 emitting yellowish orange color light on the upper side as described above, the leakage of the green color light components can be lessened when the first and second luminescent layers 4 and 5 emit lights, which results in that the color purity is increased.

Also, in this embodiment, the red color filter 8 is formed in contact with a widthwise end edge of the electrode 7*b* located above the first luminescent layer 4. As a result of this, it is possible to prevent a decrease in color purity due to leakage of light from a gap between the red color filter 8 and the electrode 7*b*.

FIGS. 4 and 5 illustrate a relation in width between the red color filter 8 and the second electrodes 7*a*, 7*b*. FIG. 4 illustrate an arrangement of the first embodiment wherein the widthwise edge of the red color filter 8 is in contact with the widthwise edge of the second electrode 7*b* and FIG. 5 illustrates an arrangement of the prior work wherein the widthwise edge of the red color filter 8 is positioned at a center between the second electrodes 7*a* and 7*b*.

Figures 13, 14:
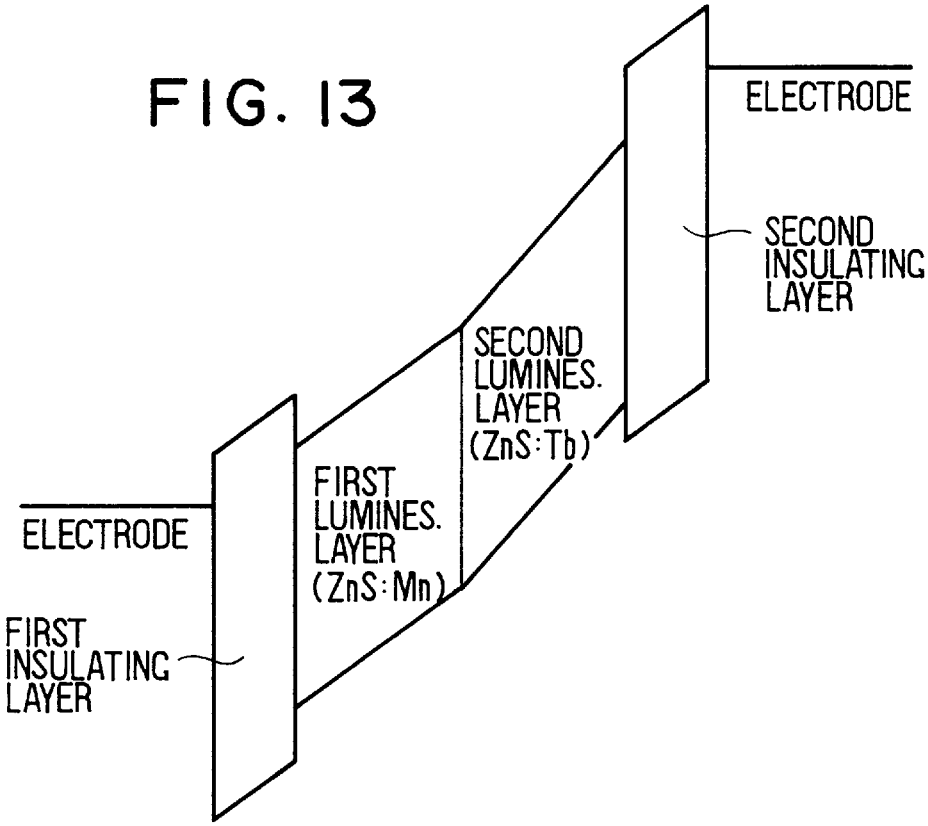
FIG. 13 is a band diagram illustrating an increase in luminance which occurs when electric charge has been injected from a second luminescent layer high in a clump electric field intensity into a first luminescent layer.
FIG. 14 is a table illustrating measured results of purity of color in the electroluminescent elements according to the first and second embodiments and in an electroluminescent element illustrated in FIG. 5.

A table in FIG. 14 illustrates a relation between the color purity (the color purity right above the red color filter) of the pixel and the color purity of the panel (the color purity obtained by causing only the red color light emitting portion to emit light and measuring over an area including both the red color light emitting portion and green color light emitting portion) when the red color filters having the widths as illustrated in FIGS. 4 and 5 are used. Note that x and y in the table are CIE chromaticity coordinates.

When the red color filter 8 is disposed as illustrated in FIG. 5, the color purity of the panel deteriorates compared to the color purity of the pixel. The reason for this is considered to be that because light emitted from the luminescent portion below the red color filter 8 has leaked from a gap between the edge of the red color filter 8 and the second electrode 7*b,* red color light components passing through the red color filter 8 and yellow color light components leaking from that gap (mixed color light components of ZnS:Mn and ZnS:Tb) have mixed with the result that the color purity has deteriorated.

Accordingly, by blocking the gap between the second electrodes 7*a* and 7*b* with the red color filter 8 as in this embodiment illustrated in FIG. 4, it is possible to prevent a decrease in color purity due to leakage of light from the above-mentioned gap.

(Modifications of First Embodiment)

Figure 6:
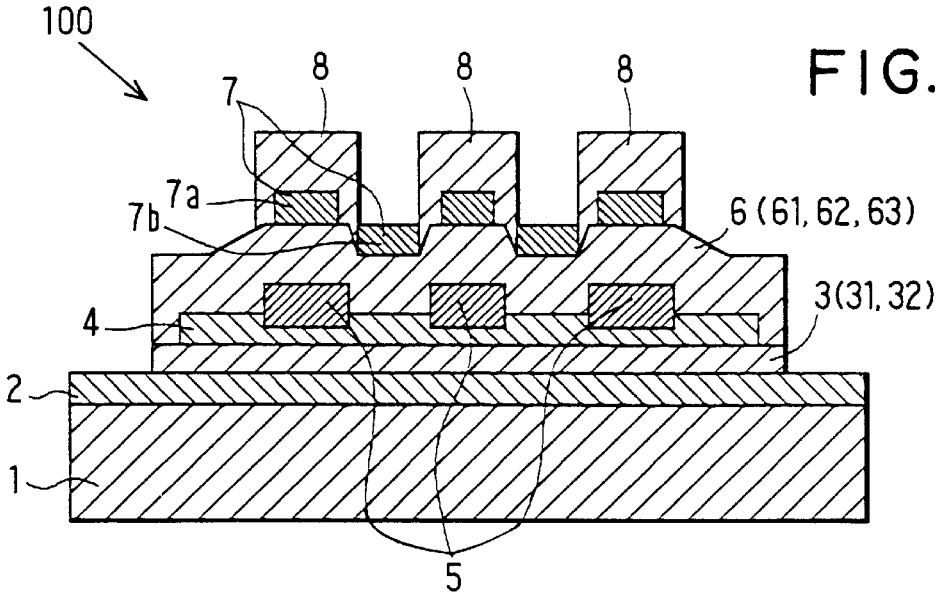
FIG. 6 is a schematic sectional view illustrating the construction of an electroluminescent element in a modified example of the first embodiment.

The above-mentioned first embodiment can be also modified such that, as illustrated in FIG. 6, the first luminescent layer 4 located under the second luminescent layer 5 is etched and decreased in thickness to thereby increase the thickness of the second luminescent layer 5.

Specifically, after the first luminescent layer 4 of 5,000 Å in thickness is formed, regions of the first luminescent layer 4 at which the second luminescent layer 5 is to be formed is etched by 1,000 Å. This etching is performed by dry etching the same as that used when the second luminescent layer 5 is etched. Thereafter, the second luminescent layer 5 of 4,000 Å in thickness is formed and this layer is etched to obtain a pattern as illustrated in FIG. 6.

As a result, the thickness of a single layer portion of the first luminescent layer 4 is 5,000 Å, the thickness of the first luminescent layer 4 at the laminated portion of the first luminescent layer 4 and the second luminescent layer 5 is 4,000 Å, and the thickness of the second luminescent layer 5 is 4,000 Å.

By decreasing the thickness of the first luminescent layer 4 as mentioned above, it is possible to decrease the luminescence threshold voltage and, by increasing the thickness of the second luminescent layer 5, it is possible to increase the luminance of red color emitted light.

Note that when the first luminescent layer 4 is made 2,000 Å or less in thickness, dead layer of the second luminescent layer 5 laminated thereon does not decrease. The reason for this is considered to be that when the thickness of the first luminescent layer 4 is 2,000 Å or less, granular growth does not proceed with the result that a state of surface of the first luminescent layer 4 is bad.

Also, preferably, the difference between the thickness of the first luminescent layer 4 and the thickness of a laminated portion of the first luminescent layer 4 and the second luminescent layer 5 is in a range of from 1,000 Å to 3,500 Å inclusive. By this difference being in such a range, it is possible to make the luminescence threshold voltage of the laminated portion equal to that of the single layer portion and also to increase the luminance of light emitted from the second luminescent layer 5 at the laminated portion of the first luminescent layer 4 and the second luminescent layer 5.

Figure 7:
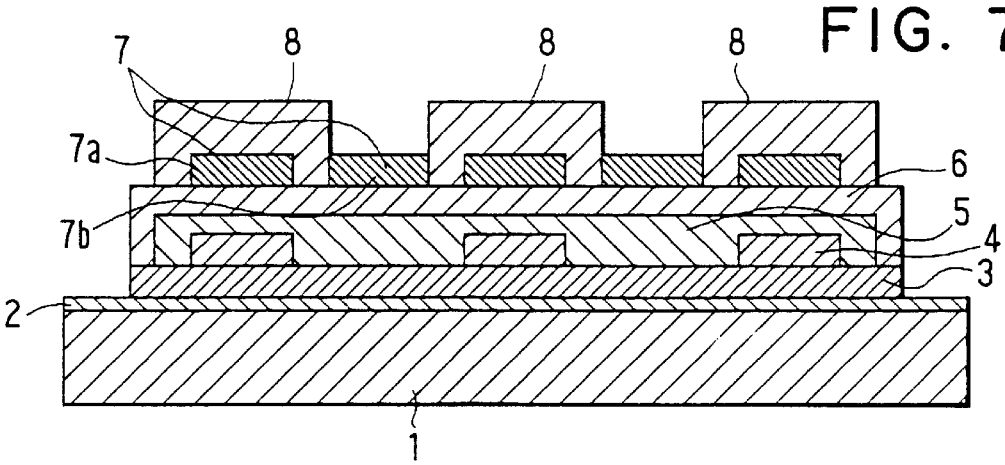
FIG. 7 is a schematic sectional view illustrating the construction of an electroluminescent element in a modified example of the first embodiment.

Also, the above-mentioned first embodiment may be modified such that a first luminescent layer 4 consists of a material of ZnS having Mn doped thereto, a second luminescent layer 5 consists of a material of ZnS having TbOF doped thereto, conversely with the first embodiment, and the thickness of the second luminescent layer 5 at the laminated portion is decreased and the thickness of the first luminescent layer 4 is increased to thereby increase the luminance of red color emitted light. A detailed structure in this case is illustrated in FIG. 7.

Figure 8:
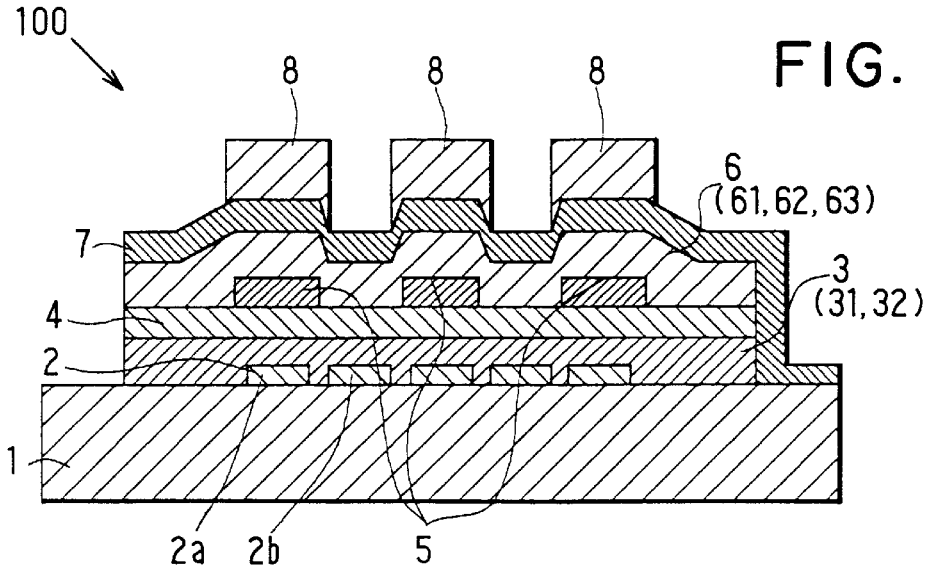
FIG. 8 is a schematic sectional view illustrating a modified example wherein the first electrodes 2 are used as column electrodes and the second electrodes 7 are used as row electrodes unlike the construction illustrated in FIG. 1.

Although in the above-mentioned first embodiment the explanation was given of the case where the first electrodes 2 are row electrodes and the second electrodes 7 are column electrodes, it may also be arranged such that the first electrodes are column electrodes and the second electrodes are row electrodes. Specifically, as illustrated in FIG. 8 (corresponding to FIG. 1), the first electrodes 2 (2*a,* 2*b*) are disposed as column electrodes and the second electrodes 7 are disposed as row electrodes.

Also, in any one of the above-mentioned embodiments, the red color filter 8 can be constituted by a resist filter wherein red dye or pigment has been dispersed in an organic solvent.

(Second Embodiment)

Figure 9:
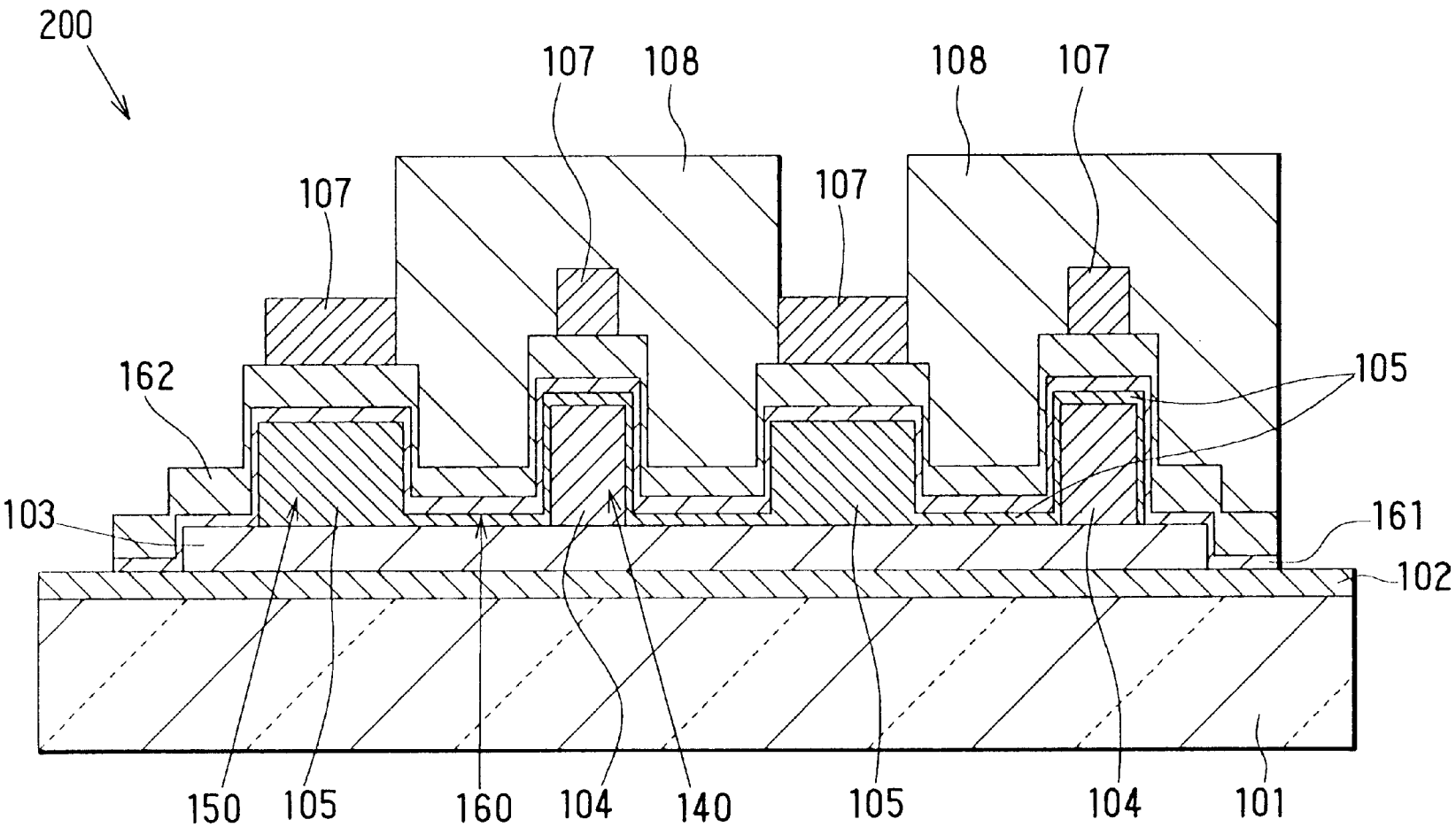
FIG. 9 is a schematic sectional view illustrating a vertical cross section of an electroluminescent element according to a second embodiment of the present invention.

FIG. 9 is a typical view illustrating a longitudinal section of an electroluminescent element in a second embodiment of the present invention, and FIG. 10 is a plan view thereof.

An electroluminescent element 200 is constructed such that the following thin films are sequentially laminated on a glass substrate 101 which is an insulative substrate. A first electrode 102 consisting of a reflective metal film of Ta (tantalum) and having a thickness of 2,000 Å. As illustrated in FIG. 10, the first electrode 102 is disposed such that a stripe extending in the x-axis direction is arranged in large number in the y-axis direction.

A first insulating layer 103 is uniformly formed on the glass substrate 1 having the first electrode 2 formed thereon. The first insulating layer 103 is an insulating layer having a thickness of 3000 to 4000 Å which is consisting of composite film (TaSnON) of $Ta_2O_3$ (tantalum oxide) including nitrogen and $SnO_2$ (tin oxide).

A first luminescent layer 104 having a thickness of 8000 Å and being made of a material of ZnS (zinc sulfide) having Mn (manganese) doped thereto is formed on the first insulating layer 103. As illustrated in FIG. 10, the first luminescent layer 104 is disposed such that a stripe extending in the y-axis direction is arranged in large number at predetermined intervals in the x-axis direction.

On the first luminescent layer 104 and first insulating layer 103 there is formed a second luminescent layer 105 made of a material of ZnS (zinc sulfide) having TbOF (terbium oxyfluoride) doped thereto. The second luminescent layer 105 is patterned such that a single layer portion 150 thereof having a thickness of 7000 Å is formed apart from the first luminescent layer 104. It is to be noted that the second luminescent layer 105 having a thickness of 1000 Å remains on the first luminescent layer 104 as well as the first insulating layer 103 located between the first luminescent layer 104 and the single layer portion 150 of the second luminescent layer 105.

In this manner, a laminated portion 140 is constituted by a portion in which the second luminescent layer 105 is laminated on the first luminescent layer 104, and a single layer portion 150 is constituted by a luminescent portion consisting of the second luminescent layer 105 having a thickness of 7000 Å. the laminated portion 140 and the single layer portion 150 function as a first and second light emitting portions, respectively. Incidentally, by patterning the second luminescent layer 105 as described above, a low level portion 160 having a width of 10 to 30 $\mu$m is formed between the laminated portion 140 and the single layer portion 150.

A second insulating layer 106 is formed on the second luminescent layer 105. The second insulating layer 106 is composed of a second lower insulating layer 161 consisting of an optically transparent $SiO_xN_y$ (silicon oxynitride) and having a thickness of 1000 Å and a second upper insulating layer 162 consisting of a composite film (TaSnON) of $Ta_2O_5$ (tantalum oxide) including nitrogen and $SnO_2$ (tin oxide) and having a thickness of 3000 Å.

On the second upper insulating layer 162 there is formed an optically transparent second electrode 107 consisting of ZnO (zinc oxide) and $Ga_2O_3$ (gallium oxide) and having a thickness of 4,500 Å. As illustrated in FIG. 10, the second electrode 107 is disposed such that a stripe extending in the y-axis direction is arranged in large number in the x-axis direction.

A red color filter 108 made of resin and having a thickness of 1.0 to 2.0 μm is formed on the second electrode 107 in a region under which the first luminescent layer 104 exists. As illustrated in FIG. 10, the red color filter 108 is formed to be a stripe-like shape in such a manner as to cover the corresponding first luminescent layer 104 and the second electrode 107, extend in parallel with the second electrode 107 (along the y-axis direction) and have a width of 120 to 180 μm. The red color filter 108 is also formed to surround the upper face and the side faces of the laminated portion 140 by inserting the red color filter 108 within the low level portions 160 located at the both sides of the laminated portion 140.

Next, a method for manufacturing the above-mentioned electroluminescent element 200 will be explained. FIGS. 11A to 11D and FIGS. 12A to 12C are plan views illustrating this manufacturing method.

Figure 11C:
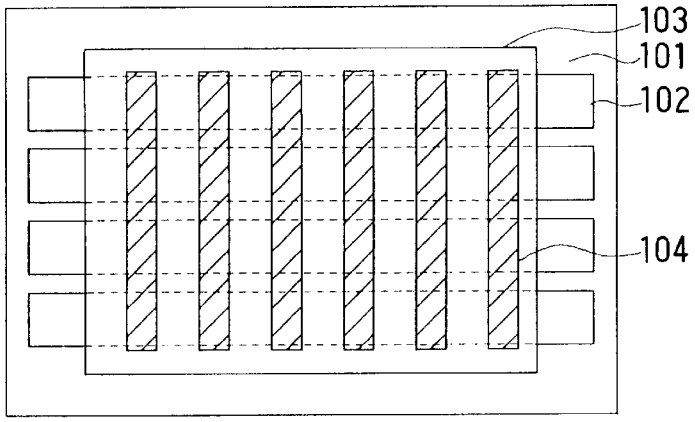
FIGS. 11A to 11D are plan views illustrating a method for manufacturing the electroluminescent element of the second embodiment of the present invention.
Figure 11D:
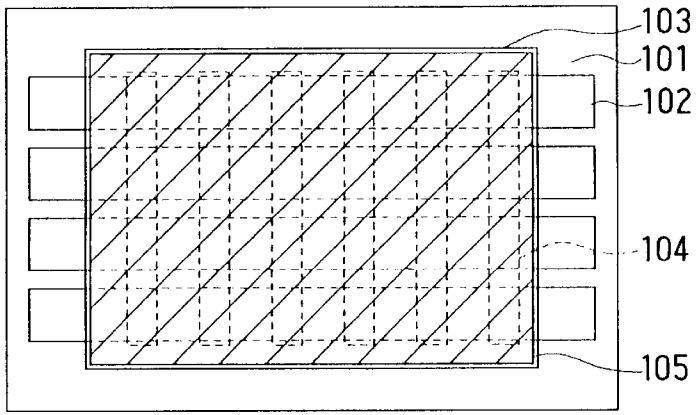
Figure 11A:
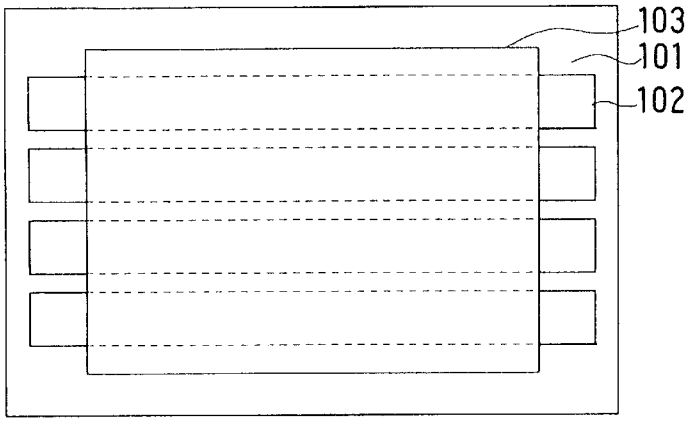

DC diode sputtering of Ta metal is performed on the glass substrate 101 and thereafter, as illustrated in FIG. 11A, the resulting metal film is etched in stripes to thereby form the first electrode 102 consisting of a metallic reflection film.

Next, the first insulating layer 103 consisting of TaSnON is formed by sputtering. Specifically, the glass substrate 101 is maintained at a temperature of 300° C., a gaseous mixture of Ar (argon), $N_2$ (nitrogen) and $O_2$ (oxygen) is introduced into a sputtering device, the gaseous pressure is maintained at a level of 0.2 Pa, and film formation is performed with a high frequency power of 2 KW by using a sintered target in which $Ta_2O_5$ (tantalum oxide) contains $SnO_2$ (tin oxide) of 10 mol %.

Figure 11B:
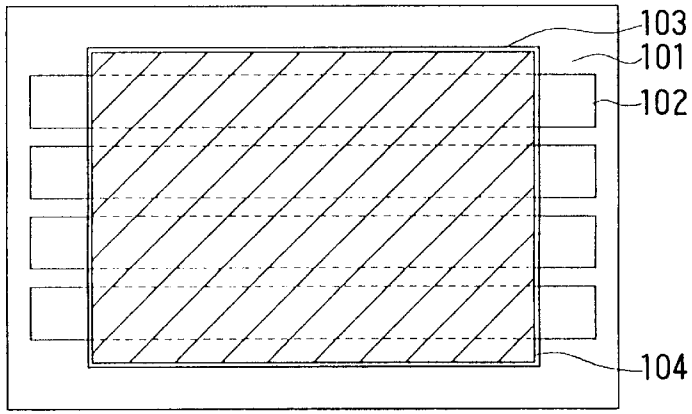

Next, as illustrated in FIG. 11B, a layer made of a material of ZnS:Mn in which ZnS is a host material and Mn is doped thereto as a luminescent center is uniformly formed by evaporation on the first insulating layer 103. Specifically, the glass substrate 101 is maintained at a constant temperature, and the interior of the evaporation device is maintained at a pressure level of $5\times10^{-4}$ Pa or less, whereby electron beam evaporation is performed at a deposition rate of 0.1 to 0.3 nm/sec. Next, this layer is etched in a form illustrated in FIG. 11C, thereby the first luminescent layer 104 is obtained.

Next, as illustrated in FIG. 3D, the second luminescent layer 105 consisting of a material of ZnS:TbOF in which ZnS is a host material and TbOF is doped thereto as a luminescent center is formed by a thickness of 7000 Å over the first luminescent layer 104 and exposed surfaces of the first insulating layer 103. Specifically, sputtering is performed to form a film under conditions wherein the glass substrate 101 is maintained at a temperature of 250° C.; Ar (argon) and He (helium) are used as sputtering gases; the gaseous pressure is 3.0 Pa; and the high frequency power is 2.2 KW.

Next, this layer is etched in a form illustrated in FIG. 9, thereby the second luminescent layer 105 is obtained. Specifically, dry etching is performed under conditions wherein the glass substrate 101 is maintained at a temperature of 10° C.; a gaseous mixture of Ar (argon) and $CH_4$ (methane) is introduced in an RIE apparatus; the gaseous pressure is 7.0 Pa; and the high frequency power is 1.0 KW. At this time, the second luminescent layer 105 is etched by a thickness of 6000 Å except for a region where the single layer portion 150 is to be formed, thereby the second luminescent layer 105 of 1000 Å remains on the first luminescent layer 104 and the first insulating layer 103 located between the first luminescent layer 104 and the second luminescent layer 105 (see FIG. 9).

In this case, the etching of the second luminescent layer 105 must be performed without giving damage to the remaining second luminescent layer 105. If the etching of the second luminescent layer 105 is performed by the same wet-etching technique as the first luminescent layer 104 is etched by, irregularity is formed on the surface of the second luminescent layer 105. On the other hand, when the dry-etching technique is used, irregularity is not formed.

Therefore, in the second embodiment, the gaseous mixture of $CH_4$ and Ar (inert gas) is used as an etching gas and the surface of the second luminescent layer 105 of which host material is ZnS is changed into $Zn(CH_3)_2$ (dimethylzinc) having a low boiling point and thereby vaporized. In these conditions, physical etching is performed by the action of Ar. As a result, because chemical etching due to $CH_4$ progresses with respect to a constantly-refreshed surface of the second luminescent layer 105, high etching rate can be assured unlike the conventional etching rate. Further, the second luminescent layer 105 can be etched without giving damage to the first luminescent layer 104.

After the etching is performed, the luminescent layers 104 and 105 are heat-treated at 400 to 600° C. in vacuum or in an atmosphere of $H_2S$.

Figure 12A:
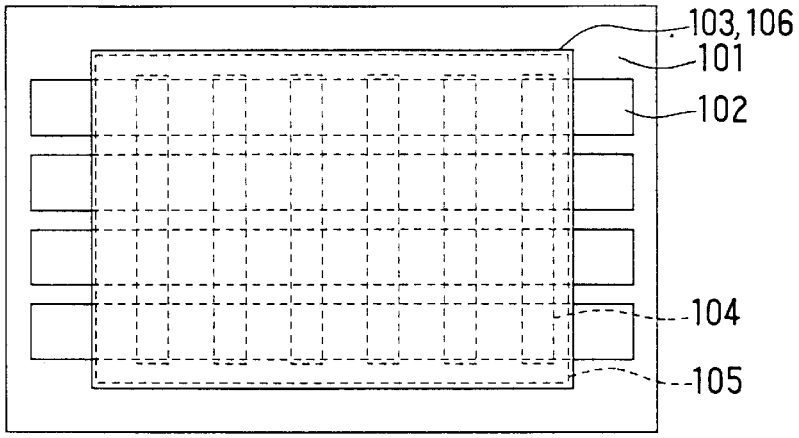
FIGS. 12A to 12C are plan views illustrating a method for manufacturing the electroluminescent element of the second embodiment, following the method illustrated in FIGS. 11A to 11D.

Next, as illustrated in FIG. 12A, on the first luminescent layer 104 and the second luminescent layer 105 there is formed the second lower insulating layer 161 consisting of a material of $SiO_xN_y$. Specifically, the glass substrate 101 is maintained at a temperature of 300° C., a gaseous mixture of Ar (argon), $N_2$ (nitrogen) and a small amount of $O_2$ (oxygen) is introduced into a sputtering device, the gaseous pressure is maintained at a level of 0.5 Pa, and film formation is performed by sputtering with a high frequency power of 3 KW by using silicon as a target. On the second lower insulating layer 161, there is formed the second upper insulating layer 162 consisting of a composite layer of $Ta_2O_5$ (tantalum oxide) containing nitrogen and $SnO_2$ (tin oxide) in the same manner as the first insulating layer 103.

Figure 12B:
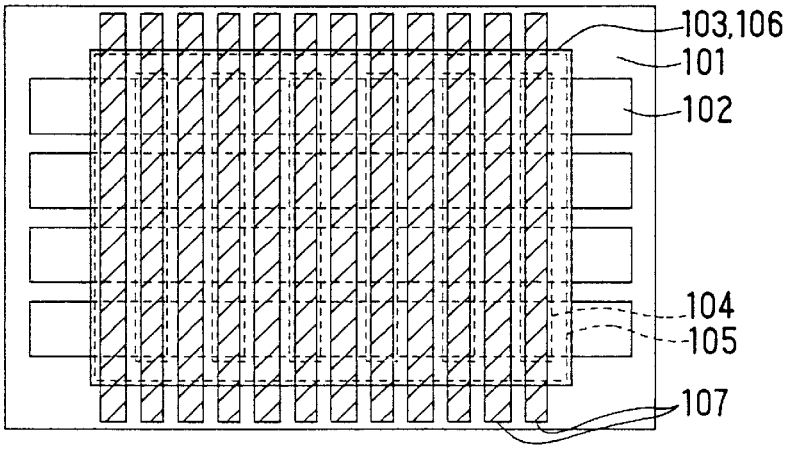

Next, a layer made of a material of $ZnO:Ga_2O_3$ is uniformly formed on the second upper insulating layer 162. As evaporation material, there was used that prepared by adding a material of $Ga_2O_3$ (gallium oxide) to a ZnO (zinc oxide) powder and forming the resulting mass into a configuration of pellets, and an ion plating device was used as a film former. Specifically, after evacuating the interior of the ion plating device into vacuum with the temperature of the glass substrate 101 being maintained at a predetermined constant value, Ar (argon) gas is introduced and the gaseous pressure is maintained at a predetermined constant value, whereupon the electron beam power and the high frequency power are adjusted so that the film forming rate may be in a range from 60 to 180 Å/min to thereby perform film formation. Next, this film is etched in such a pattern as illustrated in FIG. 12B, thereby the second electrode 107 is obtained.

Figure 12C:
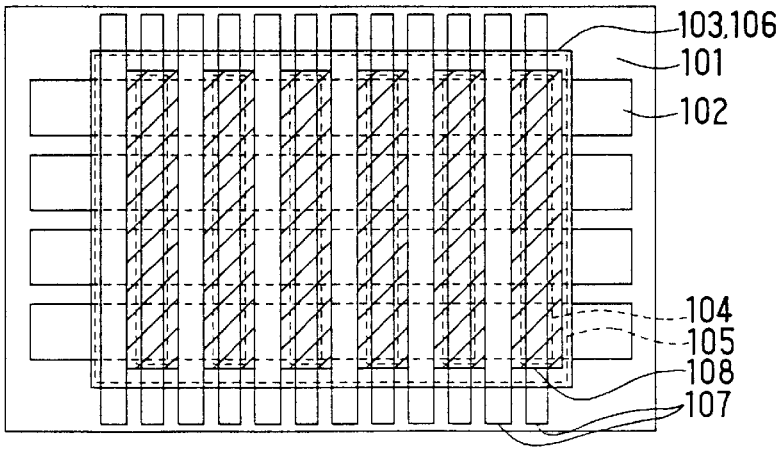

Next, a red color filter 108 of organic dye dispersed type, which transmits only light having a wavelength of 590 or more, is formed on the second electrode 107 under which the first luminescent layer 104 exists. Specifically, photoresist of positive type containing red color organic dye is dropped in predetermined quantity onto the second electrode 107, whereupon resist coating is performed for several seconds with the use of a spinner. Thereafter, as illustrated in FIG. 12C, pre-baking, exposure and development, and post baking are sequentially performed, thereby forming the red color filter 108 so as to cover the first luminescent layer 104. It is to be noted that, as a red color filter 108, photoresist of negative type containing red color organic dye can be adopted in addition to the photoresist of positive type containing red color organic dye.

In the above-mentioned construction, the first luminescent layer 104 emits yellowish orange color light and the second luminescent layer 105 emits green color light. As a result, the laminated portion 140 in which the second luminescent layer 105 is laminated on the first luminescent layer 104 emits light of the blended color of yellowish orange and green. Because light emitted from the laminated portion 140 passes through the red color filter 108, red color light having a high color purity is obtained from the red color filter 108.

Also, green color light is obtained from an overlapped portion of the second electrode 107 upon a single layer portion 150 of the second luminescent layer 105. This green color light is transmitted through no filter and therefore has a high luminance with the green color purity being nor impaired.

The clump electric field intensity of the second luminescent layer 105 is higher than that of the first luminescent layer 104. As a result, it is possible to increase the luminance of light per an unit film thickness in the first luminescent layer 104 comparing to a case where the first luminescent layer is used without the second luminescent layer 105 laminated thereon. This is considered to be because, as illustrated in a band view of FIG. 13, electric charge (hot electrons) in the second luminescent layer 105 high in the clump electric field intensity is accelerated and injected with a high acceleration energy into a first luminescent layer 104 low in the clump electric field intensity.

Therefore, even if the red color filter 108 is provided corresponding to the laminated portion 140, by adopting a laminating structure that the second luminescent layer 105 is laminated on the first luminescent layer 104, the luminance of light emitted from the first luminescent layer 104 can be increased, thereby obtaining red color light having the sufficient luminance.

In the manufacturing method described above, the low level portion 160 is formed between the laminated portion 140 and the single layer portion 150 by patterning the second luminescent layer 105. The red color filter 108 is inserted in spaces surrounded by the laminated portion 140, the single layer portion 150 and the low level portion 160. As a result, the red color filter 108 is disposed to surround the upper face and both side faces of the laminated portion 140. Therefore, if light is emitted from the side face of the first luminescent layer 104 in a direction of the low level portion 160, that is, in a longitudinal direction of the figure, that light transmits the red color filter 108, thereby converted to red color light. Consequently, light of yellowish orange emitted from the first luminescent layer 104 hardly leak out without passing through the red color filter 108 and so deterioration of color purity can be prevented.

The table in FIG. 14 illustrates a relation between the color purity of the pixel (the color purity right above the red color filter) and the color purity of the panel (the color purity measuring over an area including both the red color light emitting portion and green color light emitting portion) when only the laminated portion 140 emits light, with respect to the electroluminescent element according to the second embodiment and the electroluminescent element illustrated in FIG. 20 (FIG. 5) (which is constituted in the same way as the second embodiment except for the configurations of the first and second luminescent layers and the red color filter, for example a second insulating layer is composed of a second lower insulating layer and a second upper insulating layer). Note that x and y in the table are CIE chromaticity coordinates.

In the electroluminescent element illustrated in FIG. 20, the color purity of the panel deteriorates compared to the color purity of the pixel. The reason for this is considered to be that because light emitted from the laminated portion below the red color filter 8 has leaked from a gap between the pattern of the red color filter 8, red color light components passing through the red color filter 8 and yellow color light components leaking from that gap (mixed color light component of ZnS:Mn and ZnS:Tb) have mixed with the result that the color purity has deteriorated.

On the other hand, in the electroluminescent layer according to the second embodiment, the color purity of the pixel is the same as the color purity of the panel. That is, the color purity is not deteriorated. The reason for this is that the single layer portion 150 of the second luminescent layer 105 is apart from the laminated portion 140 of the first and second luminescent layers 104 and 105, and the red color filter 108 gets into the gap therebetween to surround even both side faces of the laminated portion 140, whereby light longitudinally advancing from the side faces of the laminated portion 140 passes through the red color filter 108.

Further, because the red color filter 108 allows light having a wavelength of 590 nm or more to pass therethrough, green color light having a wavelength less than 590 nm does not pass through the red color filter 108. Therefore, even through the red color filters 108 are located at both sides of the single layer portion 150 of the second luminescent layer 105 which emits light of green color, color purity of the red color light is not deteriorated by the green color light diagonally advancing from the single layer portion 150.

In addition, in the second embodiment, the second lower insulating layer 161 consisting of $SiO_xN_y$ (silicon oxynitride) is interposed between the second luminescent layer 105 and the second upper insulating layer 162. The reason for this is that, when the second lower insulating layer 161 which has an index of refraction (1.5 to 1.7) lower than that of the first, second luminescent layer 104 or 105 (index of refraction: approximately 2.3) utilizing ZnS as a host material, or the second upper insulating layer 162 consisting of TaSnON (index of refraction: approximately 2.1) is provided, because light diagonally emitted from the side face of the laminated portion 140 is reflected by the second lower insulating layer 161 having the lower index of refraction back to the laminated portion 140, deterioration in color purity can be further restrained. Further, the reason why the second upper insulating layer 162 consisting of TaSnON is provided is that because a dielectric constant of TaSnON is relatively high, it is effective to lower the luminescent threshold voltage.

In the above-mentioned embodiment, the first electrode 102 is used as a horizontal scan electrode and the second electrode 107 is used as a vertical signal electrode. Since the first electrode 102 is formed of metal of Ta, the resistivity thereof is lower than that of the second electrode 107. Accordingly, since the potential of the first electrode 102 in the lengthwise direction thereof can be made uniform, it is possible to prevent uneven emission of light.

Although, in this embodiment, the first electrode 102 has been formed of metal of Ta, it may be formed of metal such as Al (aluminum), Ag (silver), Mo (molybdenum), W (tungsten) or the like. Also, an auxiliary metal electrode for making the first electrode low in resistance may be added as the necessity arises.

Figure 15:
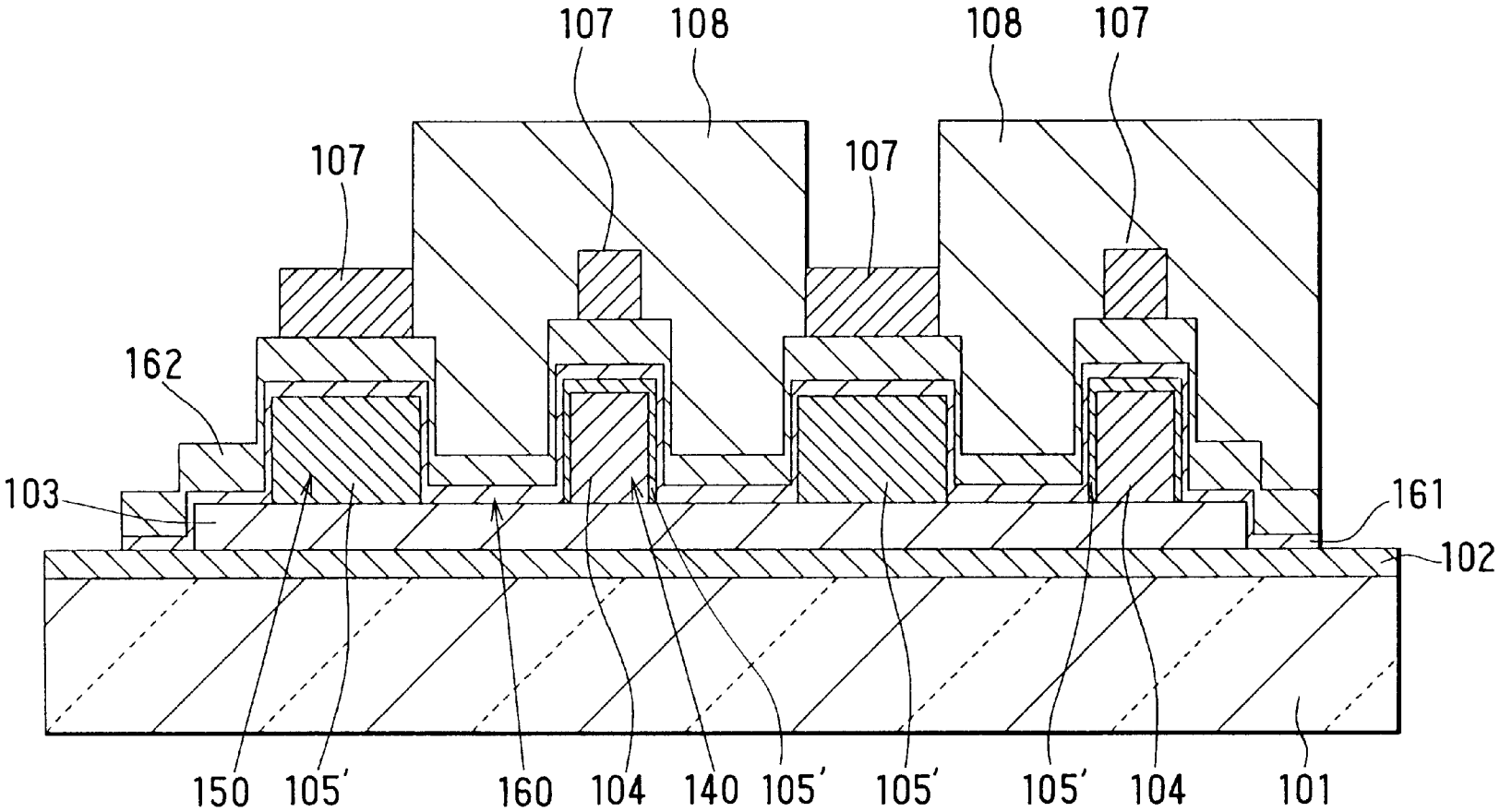
FIG. 15 is a schematic sectional view illustrating the construction of an electroluminescent element in a modified example of the second embodiment.

Note that, although the second luminescent layer having a thickness of 1000 Å remains on the first insulating layer 103 between the laminated portion 140 and the single layer portion 150, the second luminescent layer therebetween may be eliminated as illustrated in FIG. 15.

(Third Embodiment)

Figure 16:
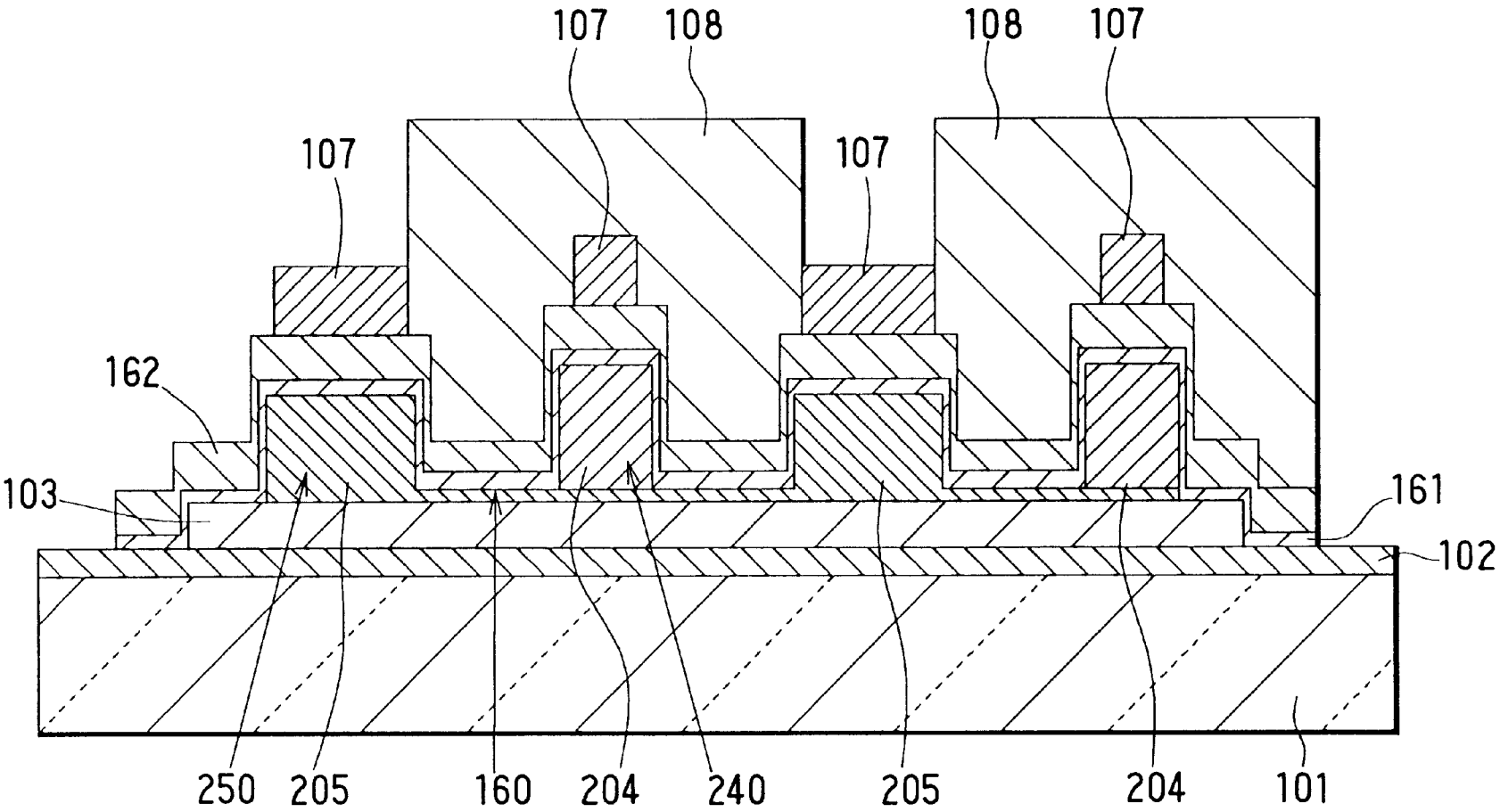
FIG. 16 is a schematic sectional view illustrating a vertical cross section of an electroluminescent element according to a third embodiment of the present invention.

FIG. 16 is a typical view illustrating a longitudinal section of an electroluminescent element in a third embodiment of the present invention. In the third embodiment, the sequence of forming a first luminescent layer 204 and a second luminescent layer 205 is opposite to that in the second embodiment. Note that the electroluminescent element in the third embodiment has the same structure as the second embodiment except for the first and second luminescent layers 204 and 205.

The first luminescent layer 204 and the second luminescent layer 205 are formed in the following manner.

On the first insulating layer 103, the second luminescent layer 205 having a thickness of 7000 Å and consisting of ZnS:TbOF in which ZnS (zinc sulfide) is a host material and TbOF (terbium oxyfluoride) is doped thereto as a luminescent center is uniformly formed by sputtering. Specifically, sputtering is performed to form a film under conditions wherein the glass substrate 101 is maintained at a temperature of 250° C.; Ar (argon) and He (helium) are used as sputtering gases; the gaseous pressure is 3.0 Pa; and the high frequency power is 2.2 KW.

Figure 17A:
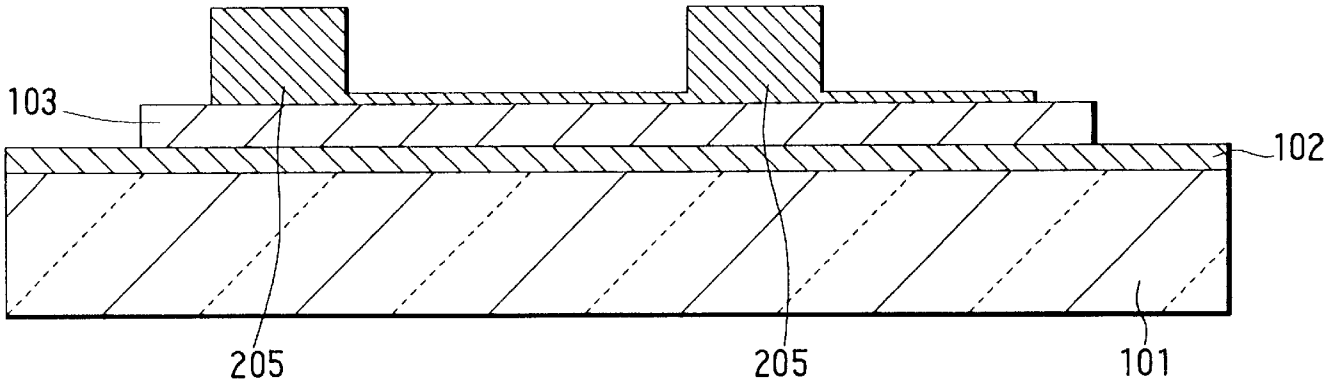
FIGS. 17A and 17B are schematic sectional view illustrating a process of manufacturing the electroluminescent element according to the third embodiment of the present invention.

Next, this layer is dry-etched in a form illustrated in FIG. 17A, thereby the second luminescent layer 205 is obtained. Specifically, dry etching is performed under conditions wherein the glass substrate 101 is maintained at a temperature of 10° C.; mixed gases of Ar (argon) and $CH_4$ (methane) are introduced in an RIE apparatus; the gaseous pressure is 7.0 Pa; and the high frequency power is 1.0 KW. In this dry etching, the second luminescent layer 205 is etched by a thickness of 6000 Å except for regions which single layer portions 250 of the second luminescent layer 205 is to be formed. As a result, the second luminescent layer 205 having a thickness of 1000 Å remains on the first insulating layer 103 between the single layer portions 250.

Figure 17B:
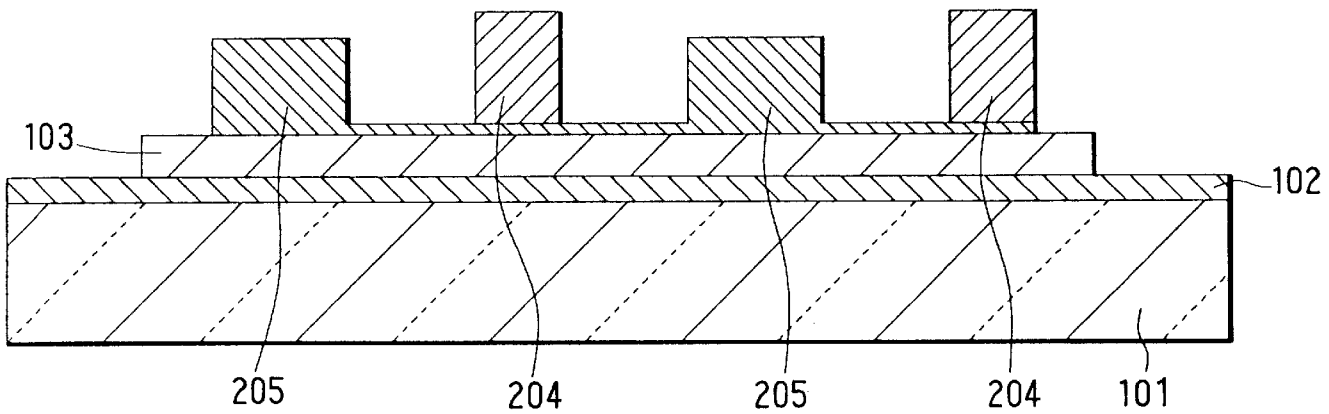

Next, a layer made of a material of ZnS:Mn in which ZnS is a host material and Mn is doped thereto as a luminescent center is uniformly formed in a thickness of 8000 Å by evaporation on the first insulating layer 103. Specifically, the glass substrate 101 is maintained at a constant temperature, and the interior of the evaporation device is maintained at a pressure level of $5\times10^{-4}$ Pa or less, whereby electron beam evaporation is performed at a deposition rate of 1.0 to 3.0 Å/sec. Next, this layer is etched in a form illustrated in FIG. 17B, thereby the first luminescent layer 204 is obtained.

In the third embodiment as well, the first luminescent layer 204 and the second luminescent layer 205 are formed apart from each other and the red color filter 108 gets into the gaps therebetween, thereby surrounding the upper face and both side faces of the first luminescent layer 204. Therefore, if light is longitudinally emitted from the side face of the first luminescent layer 204, that light is converted to light of pure red color by passing through the red color filter 108 adjacent to the side face of the first luminescent layer 204, thereby emitting red color light having remarkably high color purity.

(Fourth Embodiment)

Figure 18:
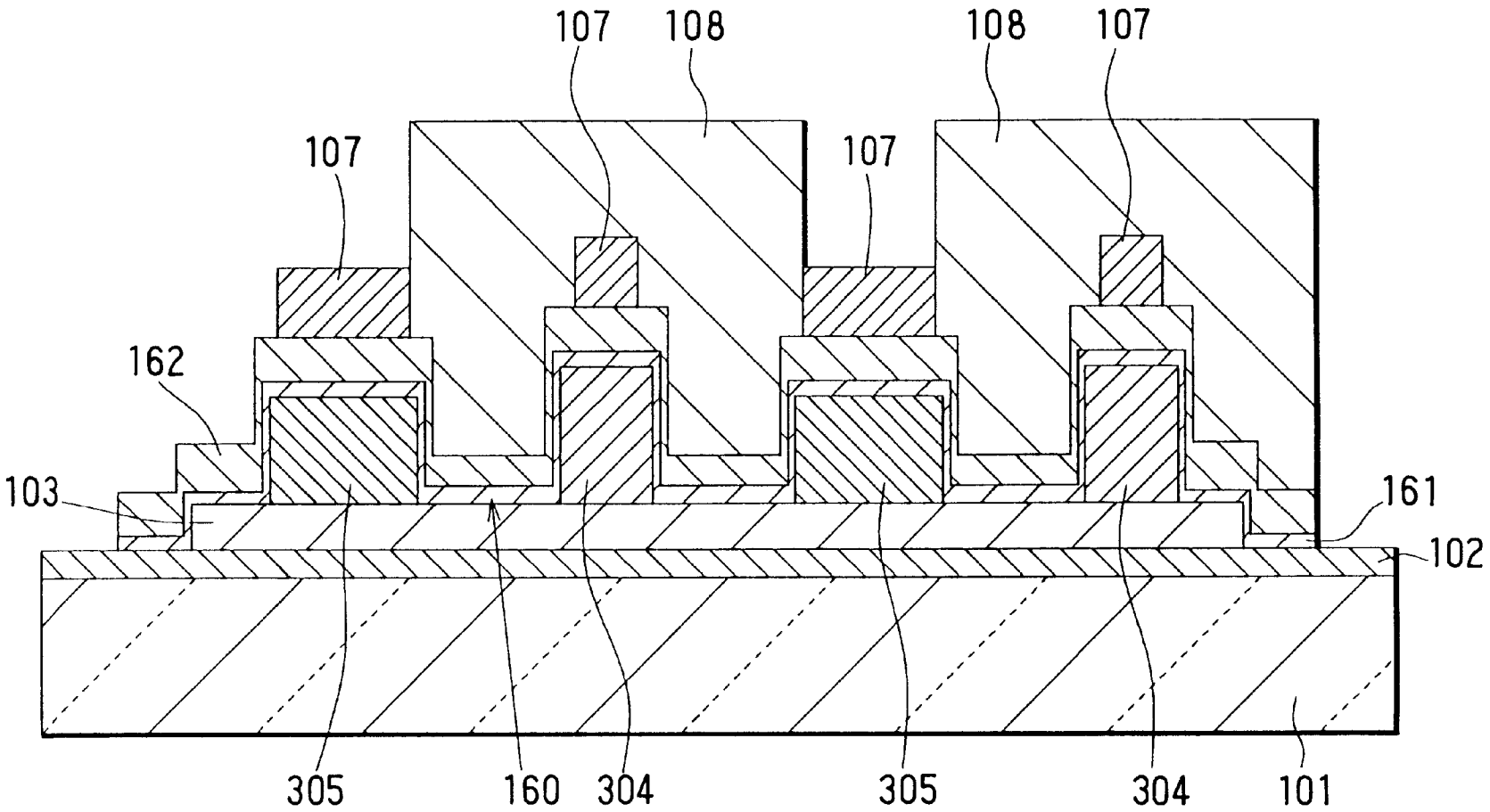
FIG. 18 is a schematic sectional view illustrating a vertical cross section of an electroluminescent element according to a fourth embodiment of the present invention

FIG. 18 is a typical view illustrating a longitudinal section of an electroluminescent element in a fourth embodiment of the present invention. In the fourth embodiment, a first luminescent layer 304 and a second luminescent layer 305 is completely separated from each other. That is, the electroluminescent element does not have laminated portions as illustrated in the second and third embodiments.

In the fourth embodiment, the red color filter 108 gets into the gaps between the first and second luminescent layers 304 and 305, thereby surrounding the upper face and both side faces of the first luminescent layer 304. Therefore, if light is longitudinally emitted from the side face of the first luminescent layer 34, that light is converted to light of pure red color by passing through the red color filter 108, thereby emitting red color light having remarkably high color purity.

The manufacturing method for the electroluminescent element in the fourth embodiment is substantially the same as that for the electroluminescent element in the third embodiment. However, in the fourth embodiment, when dry-etching the second luminescent layer 305, the second luminescent layer 305 is completely etched between the single layer portions 350, that is, the second luminescent layer 305 having a thickness of 1000 Å does not remain on the first insulating layer 103.

(Other Embodiments)

Figure 19:
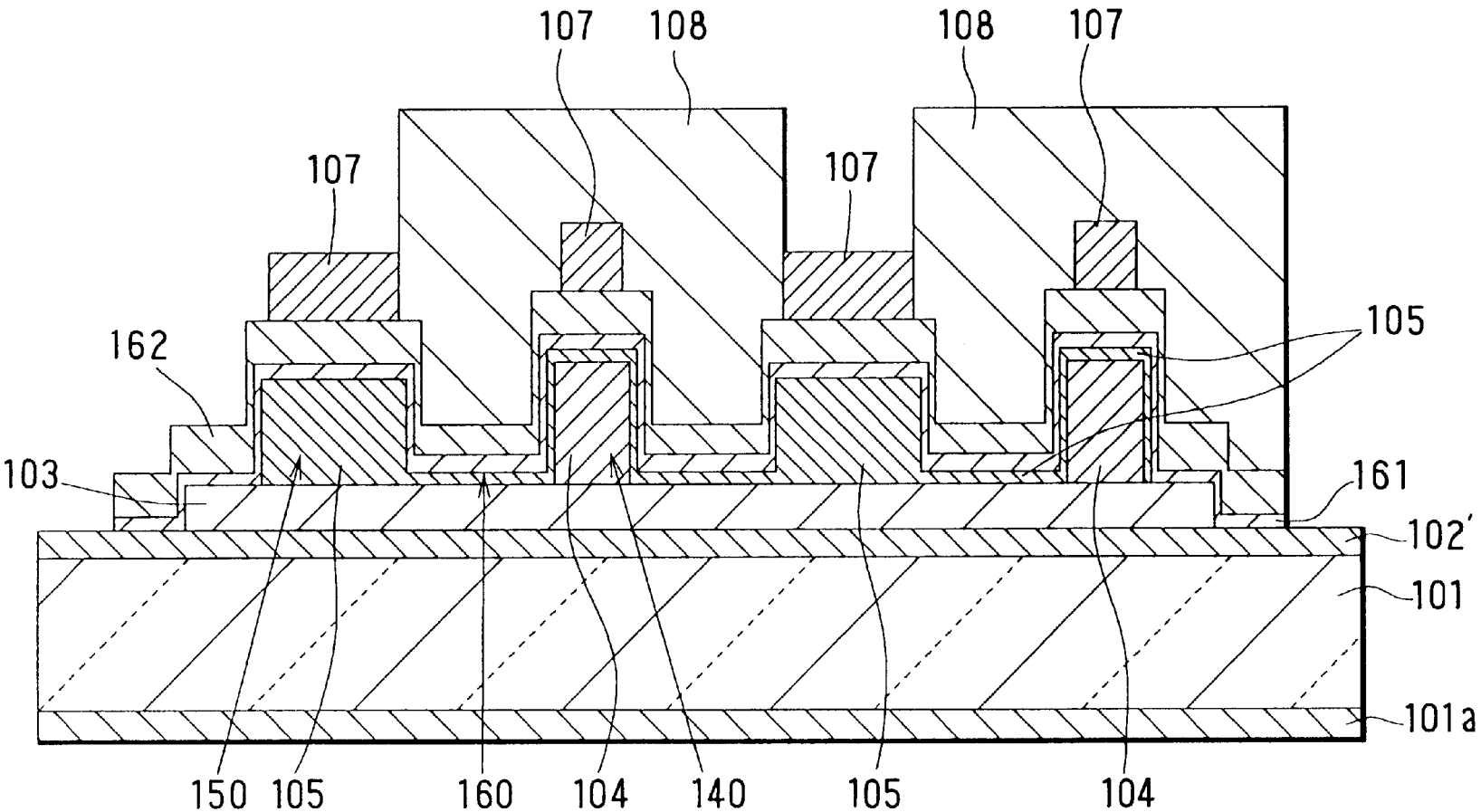
FIG. 19 is a schematic sectional view illustrating a vertical cross section of an electroluminescent element according to a fifth embodiment of the present invention.

In the embodiments described above, it may be arranged such that the first electrode is formed of a transparent electrode 102' instead of a reflecting electrode and, as illustrated in FIG. 19, a black color layer 101*a* is formed on a side opposite to the side of the glass substrate 101 on which the element is formed. In this case, it becomes difficult to visually recognize the red color filter 108 to thereby enable a decrease in the unnaturalness in color due to the red color filter 108. Resin coating containing black pigment or a black color film or the like can be adopted instead of the black color layer 101*a*. Also, the glass substrate 101 itself may be formed of a black color insulative substrate.

Furthermore, an additive which is doped to ZnS of the host material of the first luminescent layer may be $MnF_2$ or $MnCl_2$ in addition to Mn. An additive which is doped to ZnS of the host material of the second luminescent layer may be TbOF, $TbF_3$ or $TbCl_3$ in addition to Tb.

Furthermore, an electroluminescent display element which can display an image with full-color can be obtained if an electroluminescent element emitting blue color light is disposed opposite to the electroluminescent element emitting red color light and green color light as described above. In this case, because red color emitted light through the red color filter has a high color purity, a large variety of colors can be made by adjusting brightness of the lights emitted from the electroluminescent elements.

When two luminescent layers are laminated, and a red color filter and a green color filter are provided above the laminated luminescent layers as disclosed in JP-A-2-112195, the laminated luminescent layers are patterned to form first and second luminescent portions apart from each other. Further, the red color filter and the green color filter may be disposed on the first and second luminescent portions to surround the upper face and side faces of each of the first and second luminescent portions, respectively.

While the present invention has been shown and described with reference to the foregoing preferred embodiments, it will be apparent to those skilled in the art that changes in form and detail may be made therein without departing from the scope of the invention as defined in the appended claims.

What is claimed is:

1. An electroluminescent display element comprising:

a substrate;

a first electrode deposited on the substrate;

a luminescent layer which has first and second luminescent portions located apart from each other;

a second electrode including a first part electrode for activating the first luminescent portion and a second part electrode for activating the second luminescent portion;

first and second insulating layers interposed between the first electrode and the luminescent layer and between the second electrode and the luminescent layer, respectively; and a color filter provided above at least one of the first and second luminescent portions, the color filter being formed so that a side face of the color filter reaches a side edge of either of the first and second part electrodes which activates a luminescent portion adjacent to a luminescent portion above which the color filter is provided.

2. An electroluminescent display element according to claim 1, wherein the side face of the color filter makes contact with a side face of either of the first and second part electrodes which activates a luminescent portion adjacent to a luminescent portion above which the color filter is provided.

3. An electroluminescent display element according to claim 1, wherein the first luminescent portion and the second luminescent portion in the luminescent layer are located apart from each other on the same plane, and the color filter is disposed so that a portion extending from a bottom face of the color filter gets into a gap between the first and second luminescent portions, whereby the color filter surrounds the upper and side faces of the one of the first and second luminescent portions.

4. An electroluminescent display element according to claim 3, wherein the first luminescent portion is formed by a laminated portion in which a first luminescent layer and a second luminescent layer having emission light colors different from each other are laminated, the second luminescent portion is formed by a single-layer portion consisting of the second luminescent layer, and the second luminescent layer has a clump electric field intensity higher than that of the first luminescent layer.

5. An electroluminescent display element according to claim 4, wherein the first luminescent layer is made of zinc sulfide (ZnS) containing manganese (Mn), the second luminescent layer is made of zinc sulfide (ZnS) containing terbium (Tb) and the color filter is a red-color filter.

6. An electroluminescent display element according to claim 5, wherein the substrate is formed from black-color background plate.

7. An electroluminescent display element according to claim 3, wherein the second insulating layer is composed of a second insulating lower-layer formed on the luminescent layer and a second insulating upper layer formed on the second insulating lower-layer, the second insulating lower layer having an index of refraction lower than the luminescent layer and the second insulating upper-layer.

8. A method of manufacturing an electroluminescent display device comprising the steps of:

preparing a substrate;

forming a first electrode on the substrate;

forming a first insulating layer on the first electrode;

forming a luminescent layer on the first insulating layer, the luminescent layer having first and second luminescent portions located apart from each other;

forming a second insulating layer on the luminescent layer;

forming a second electrode including a first part electrode for activating the first luminescent portion and a second part electrode for activating the second luminescent portion on the second insulating layer; and providing a color filter above at least one of the first and second luminescent portions, the color filter being formed so that a side face of the color filter reaches a side edge of either of the first and second part electrodes which activates a luminescent portion adjacent to a luminescent portion above which the color filter is provided.

9. An electroluminescent display element comprising:

a substrate;

a first electrode deposited on the substrate;

a luminescent layer which has first and second luminescent portions located apart from each other;

a second electrode including a first part electrode for activating the first luminescent portion and a second part electrode for activating the second luminescent portion;

first and second insulating layers interposed between the first electrode and the luminescent layer and between the second electrode and the luminescent layer, respectively; and a color filter provided above at least one of the first and second luminescent portions, the color filter being formed so that a portion extending from a bottom face of the color filter is inserted into a gap between the first and second luminescent portions to surround an upper face and side faces of the one of the first and second luminescent portions.

10. An electroluminescent display element according to claim 9, wherein a side face of the color filter makes contact with a side face of either of the first and second part electrodes which activates a luminescent portion adjacent to a luminescent portion above which the color filter is provided.

11. An electroluminescent display element according to claim 9, wherein the first luminescent portion and the second luminescent portion in the luminescent layer are located apart from each other on the same plane, and the color filter is formed at least to face a side face of the one of the first and second luminescent portions, whereby light emitted from the side face of the one of the first and second luminescent portions passes through the portion extended from the bottom face of the color filter.

12. An electroluminescent display element according to claim 9, wherein the first luminescent portion is formed by a laminated portion in which a first luminescent layer and a second luminescent layer having emission light colors different from each other are laminated, the second luminescent portion is formed by a single-layer portion consisting of the second luminescent layer, and the second luminescent layer has a clump electric field intensity higher than that of the first luminescent layer.

13. An electroluminescent display element according to claim 12, wherein the first luminescent layer is made of zinc sulfide (ZnS) containing manganese (Mn), the second luminescent layer is made of zinc sulfide (ZnS) containing terbium (Tb) and the color filter is a red-color filter.

14. An electroluminescent display element according to claim 13, wherein the substrate is formed from black-color background plate.

15. An electroluminescent display element according to claim 9, wherein the second insulating layer is composed of a second insulating lower-layer formed on the luminescent layer and a second insulating upper layer formed on the second insulating lower-layer, the second insulating lower layer having an index of refraction lower than the luminescent layer and the second insulating upper-layer.

16. A method of manufacturing an electroluminescent display device comprising the steps of:

preparing a substrate;

forming a first electrode on the substrate;

forming a first insulating layer on the first electrode;

forming a luminescent layer on the first insulating layer, the luminescent layer having first and second luminescent portions located apart from each other;

forming a second insulating layer on the luminescent layer;

forming a second electrode including a first part electrode for activating the first luminescent portion and a second part electrode for activating the second luminescent portion on the second insulating layer; and providing a color filter above at least one of the first and second luminescent portions, the color filter being formed so that a portion extending from a bottom face of the color filter is inserted into a gap between the first and second luminescent portions to surround an upper face and side faces of the one of the first and second luminescent portions.

* * * * *